United States Patent [19]

Rigg et al.

[11] Patent Number: 4,528,909

[45] Date of Patent: Jul. 16, 1985

[54] PRINTING MEMBERS

[75] Inventors: Anthony W. Rigg; Phillip R. Kellner; Mohammed A. Sahi; Alan R. Gamson, all of London, England

[73] Assignee: Crosfeld Electronics Limited, London, England

[21] Appl. No.: 475,656

[22] Filed: Mar. 15, 1983

[30] Foreign Application Priority Data

Mar. 15, 1982 [GB] United Kingdom ..... 8207530
Jun. 8, 1982 [GB] United Kingdom ..... 8216565

[51] Int. Cl.[3] ..... B41M 1/10; B41N 1/00; B05D 3/06

[52] U.S. Cl. ..... 101/395; 101/170; 427/53.1; 427/195; 427/271; 427/386

[58] Field of Search ..... 427/53.1, 271, 195, 427/386; 101/395, 170

[56] References Cited

U.S. PATENT DOCUMENTS

| | | | |
|---|---|---|---|
| 3,232,231 | 2/1966 | DeMaria | 101/395 |
| 3,455,239 | 7/1969 | Smith | 101/395 |
| 3,558,290 | 1/1971 | Baier et al. | 101/395 X |
| 4,322,456 | 3/1982 | Martin | 427/195 |

*Primary Examiner*—Michael R. Lusignan
*Attorney, Agent, or Firm*—Sughrue, Mion, Zinn, Macpeak, and Seas

[57] ABSTRACT

A print member has a print surface of an epoxy novolac resin. It is particularly suitable for use as an intaglio print member that is to be laser engraved. It is best made by powder coating a powdered epoxy novolac composition onto the substrate fusing and curing it, polishing it to give non-print characteristics and then further curing it, either before or after engraving.

38 Claims, No Drawings

PRINTING MEMBERS

Printing members for intaglio printing, particularly gravure printing, have traditionally had a print surface formed of copper. Recently various proposals have been made to form the print surface of other materials. For instance in British Patent Specification Nos. 1,465,364, 1,498,819 and 1,517,714 it is proposed to form the print surface of two materials, one material defining cells of the required cell pattern and the other material filling the cells and being, for instance, an epoxy resin. Epoxy coatings are also proposed in British Patent Specification No. 1,544,748.

We describe in British Patent Specification No. 2034636 how the print surface of an intaglio print member can be formed of certain polymeric materials and can be engraved by an ion, electron or laser beam to give a sharp print without a rim around the engraved area. The preferred polymeric material is a polyacetal copolymer but epoxy coatings are also described. The print surface is generally preformed as a sheet and then applied to a substrate. Unfortunately it can be rather difficult to form a satisfactory surface layer by this technique. In British Patent Specification No. 2071574 it is proposed to form the print surface by powder spraying a powdered epoxy coating composition that contains little or no filler.

Various types of epoxy resins are known. For instance it is common to provide powdered epoxy coating compositions based on diglycidyl ethers of bisphenol A. Cycloaliphatic epoxy coating compositions are also known. Another type of epoxy coating composition is an epoxy novolac composition. However such compositions are known to have a tendency to form surfaces having inferior surface properties compared to many other types of epoxy resin. For instance it is known that epoxy novolac resins tend to suffer from an increased likelihood of the effect known as "orange peel effect".

It is known to use epoxy novolacs as a component for improving the adhesion between a substrate and a layer to be bonded to it (for instance as in U.S. Pat. No. 4210569). Also it is known to blend a urethane formed between a novolac and a polyisocyanate with an epoxy resin, as in British Patent Specification No. 2031442. However this does not form an epoxy novolac.

When using conventional powered epoxy compositions, as in British Patent Specification No. 2071574, we find that reasonably satisfactory properties are obtained provided the filler content is kept low, as described in that specification, although it would be desirable to be able to achieve clearer engraving with the laser or other beam. Thus these epoxies tend to result in the engraved cells having slightly sloping or irregular sides, this in turn leading to a possible lack of clarity when the resultant surface is used for gravure printing. Also it would be desirable to improve the wear resistance of the print surfaces.

We have now surprisingly found that, despite the known disadvantages of epoxy novolac resins, improved results are obtained when the print surface of a print member is formed of a composition comprising an epoxy novolac resin. Thus despite the known disadvantages of epoxy novolac resins we find that it is possible to obtain print surfaces that have very satisfactory engraving and printing properties, and in particular that have improved engraving properties (especially when engraved by laser) and that can have extremely good wear resistance during printing Known epoxy novolac resins are suitable for use in the invention. The resins are applied to a substrate in an uncured or partially cured form and then cured on the substrate to form the desired cured continuous print surface. Epoxy novolacs that are to be cured comprise either a blend of an epoxy with a novolac, that will react on curing, or comprise a novolac resin containing epoxy groups, that will cross-link on curing.

One useful form of epoxy novolac for use in the invention is obtained by reacting a novolac resin with epichlorhydrin, generally in proportions such that the resultant novolac resin is substituted by at least 2 epoxy groups per molecule. Thus it can be regarded as a glycidyl ether of a novolac resin. This is cured on the substrate in the presence of curing agent or accelerator.

Another, and preferred, type of novolac resin for use in the invention is a blend of an epoxy resin with at least 0.5 moles novolac resin per mole epoxy resin. This blend is applied to the substrate and is cured on the substrate to complete reaction between the epoxy resin and the novolac resin. The epoxy resin that is reacted with the novolac is preferably based on bisphenol A, generally being a reaction product of epichlorhydrin with bisphenol A. This reaction product may be further reacted with other components, for instance a dimeric carboxylic acid. The novolac resin is preferably used in an amount of at least 1, and preferably 1.1 moles or more novolac per mole epoxy. Best results are generally obtained with around 1.25 moles novolac per mole epoxy although in some instances amounts of up to 2, 3 or even more moles novolac per mole epoxy may be preferred, as explained below.

These epoxy novolac blended resins will generally include an additional curing agent or accelerator so as to promote the final curing.

The phenolic groups from which the novolac is formed may be derived from phenol itself or from substituted phenols, for instance a cresol. It is particularly preferred that the phenol should be substituted by groups additional to the hydroxy group required for forming the novolac and preferably some or all of the benzene groups in the novolac are substituted by additional hydroxy or alkoxy, generally methoxy, groups.

The print member is made by applying the curable epoxy novolac composition onto a substrate and then curing it to form the desired continuous print surface and then polishing the print surface to give non-print characteristics. Generally the application is by powder coating of a powdered epoxy novolac composition.

The powdered composition, and the print surface that is finally produced from it, preferably consists mainly of epoxy novolac, generally in an amount of at least 80% and preferably at least 90% by weight of the composition. The composition will include any necessary curing agents or accelerators for instance an acid anhydride or amine curing agent. The composition may include small amounts, generally below 10%, of conventional flowing agents such as waxes, soaps and alkali metal salts.

The composition may contain some filler but the amount should be below 20%, and preferably below 15%, by weight. In particular the composition is preferably totally free of the conventional bulk fillers such as bauxite, alumina or barium sulphate. Whilst it may contain small amounts of various fillers it is particularly preferred that the composition contains carbon black, generally in an amount of from 0.5 to 10%, most preferably 1 to 5%, by weight based on the total composition. As explained in our specification number 2071574 the presence of carbon black reduces the threshold required for laser engraving and so improves the quality of engraving and the maintenance of non-print characteristics between the engraved cells.

The composition may also include from 0.05 to 10% by weight, most preferably 0.5 to 5%, of an additive selected from graphite, polytetrafluoroethylene and, most preferably, molybdenum disulphide. As explained in our British Patent Application No. 8133417 filed 5th Nov. 1981 the inclusion of such additives, and especially molybdenum sulphide, reduces tool wear during diamond turning and increases the wear resistance during printing of the resultant print surface.

The powdered composition may be deposited on the substrate by electrostatic coating, floc spraying, fluidised bed coating or, preferably, a combined electrostatic and fluidised bed coating method. This latter method is particularly advantageous since the electrostatic forces ensure very uniform deposition of a mono particulate layer and the fluidised bed technique results in this uniform sub-layer being built up to a layer of the desired thickness and having great uniformity.

The substrate is generally preheated to a temperature at which the powder will fuse upon contact with the substrate, or upon contact with epoxy resin already deposited on the substrate. The composition must be cured by heating on the substrate. The temperature and duration of the heating will be chosen having regard to the particular epoxy novolac and curing agents used, and their relative amounts. The commercially available systems generally require curing at a temperature of 180° to 250° C., preferably 210° to 240° C. for periods of half to six hours, preferably two to four hours. However these temperatures and/or times may be reduced by increasing the amount of accelerator in the composition.

In one method the substrate is heated to a temperature at which the powdered composition fuses sufficiently to form an adherent layer but at which the composition does not cure. After the desired thickness of epoxy novolac composition has been built up on the substrate the entire assembly is then heated to a higher temperature at which curing will occur. In a preferred method however the substrate is preheated to the curing temperature of the epoxy resin and the epoxy resin is powder coated onto the heated substrate and flows to form a uniform layer of resin that cures substantially without further heating. Thus little or, preferably, no external heating is applied and the fusing and curing results entirely from the preheating of the substrate. This is very advantageous as it eliminates the need for heating the print member after the powder coating step. The powdered epoxy novolac composition will have to be formulated, in known manner, to ensure that it does not sag or flow unacceptably at the fusing and curing temperature.

The surface obtained by fusing and curing the powdered composition is then polished to give it non-print characteristics in intaglio printing. Generally the substrate and the print surface are cylindrical and the polishing is by diamond turning, but various methods of imparting non-print characteristics to intaglio surfaces are available and can be used.

The print surface can then be engraved, generally by ion or electron beam or, preferably, by laser. The print surface must be of a thickness such that it can be engraved to the desired depth. For instance intaglio print surfaces are engraved to a depth of up to 30 microns and the layer of epoxy novolac is generally 0.2 to 1.5 mm, preferably 0.4 to 1 mm and most preferably 0.6 to 0.8 mm thick.

If engraving does result in deposition of easily removable debris, either as a rim around each cell or elsewhere, then this can be removed by etching with a solvent or chemical etch, as described in British Patent Specification No. 2071574. Although the surface may then be subjected to electroless metal plating, as described in the specification, a particular advantage of the invention is that the print surface can have very good wear resistance and scratch resistance without plating.

In particular we find that it is possible to obtain a very large increase in the scratch resistance and wear resistance properties of the cured surface by applying a further heating step.

The curing conditions (before polishing) will have been selected to give optimum curing of the polymeric composition, which contains epoxy groups. It is well known that further curing of an epoxy composition, by application of high temperature, is generally undesirable as it may give stress cracking or degradation.

The surprising improvement in properties we obtain by further heating the polished surface is therefore particularly unexpected.

This further high temperature treatment or curing, that may be likened to "case hardening", may be applied to the polished surface before engraving or may be applied to the engraved surface. If it is applied to the polished surface before engraving it is usual to polish the surface again after the post-cure and before engraving.

The post-cure is achieved by subjecting the polished surface to high temperature curing, generally at a temperature above the curing temperature that was used before polishing. The temperature is generally from 180° to 280° C., preferably 200° to 260° C. and most preferably about 240° C., and is generally applied for periods of half to six hours, preferably 1 to 3 hours. It appears that the heating results in a condensation reaction between phenolic groups of the novolac and consequential expulsion of water. It appears that the reaction only occurs in the outer surface of the layer. It is easy to select the optimum conditions for the heating, after the polishing operation, by routine experimentation and observation of which temperatures and durations give the greatest hardness and scratch resistance.

The effect is highest when the novolac epoxy resin includes reactive groups capable of entering into condensation reactions. It is therefore desirable for the novolac epoxy resin to contain an excess of novolac, preferably at least 1.25 moles novolac per mole epoxy and preferably considerably more, e.g. up to 2 or 3 or even more moles novolac per mole epoxy. Another way of ensuring particularly good final properties is for the novolac to be formed from a phenol containing more substituents than the single hydroxy group of phenol, for instance it is preferred for the phenolic component to contain at least a second hydroxy group and/or an alkoxy group, preferably a methoxy group. Best results are obtained when the phenolic component of the novolac is a methoxy or other alkoxy substituted benzene diol or higher polyol and when the phenolic component is present in an amount of at least 1.2 moles per mole epoxy.

When the epoxy novolac is a highly reactive epoxy novolac containing a significant excess of novolac or containing benzene rings containing additional reactive groups such as hydroxy or methoxy it may be desirable to use a less reactive epoxy novolac to ensure good adhesion between this highly reactive epoxy novolac and the metal or other substrate on which the print surface is formed. For instance a primer layer of, typically, 50 to 175, and generally around 125, microns may be formed of a conventional relatively low functional novolac epoxy and a top coat 150 to 500 microns, typically 200 to 300 microns, may then be applied of the higher functional epoxy, in which the novolac is present in a larger amount and/or is formed from a phenol containing additional hydroxy or other suitable substituents. The primer layer may consist solely of epoxy novolac and curing agent but the outer layer preferably includes carbon black, as mentioned above. The increased wear resistance obtainable as a result of the "case hardening" may be so high as to render it unnecessary to include molybdenum sulphide in the composition of the outer layer.

We have observed that it is very undesirable to trap water molecules within the continuous layer of epoxy novolac composition and in particular that it is desirable to carry out the or each powder coating technique under conditions of low relative humidity, preferably below 30% and most preferably below 15%.

The following are examples of the invention.

EXAMPLE 1

A metal cylinder is heated to 200° C. and, while earthed, a powdered epoxy composition is sprayed onto the cylinder using an electrostatic powder spray gun. The composition consists mainly of a phenolic novolac epoxy formed by reaction of a phenolic novolac with epichlorhydrin but contains also conventional curing agent and other additives, but no bulk fillers, 2% benzoin as air release agent, 2% molybdenum sulphide and 5% carbon black, all by weight based on the total composition. When the desired coating thickness of about 0.8 mm has been achieved the cylinder and coating are heated at about 220° C. for 3 hours in order to fuse and cure the coating. It is then diamond turned and laser engraved and optionally etched and optionally further etched and metal plated as described in British Patent Specification No. 2071574.

EXAMPLE 2

A cylinder is powder coated as described in example 1 but using two different compositions. The first composition, which is applied to a thickness of 125 microns, is a phenolic novolac epoxy formed by reaction of 1.25 moles of phenolic novolac with epichlorhydrin, the phenol component of the novolac being hydroxy benzene. This primer composition also contains curing agent and air release agent. On top of the primer composition there is applied a layer 250 microns thick of a phenolic novolac epoxy formed by reaction of 1.25 moles phenolic novolac with epichlorhydrin, the phenolic component being methoxy benzene diol. This outer composition also contains curing agent and 5% carbon black. Both compositions are sprayed under conditions of low relative humidity, about 15%.

The cylinder and coating are heated at about 220° C. for 3 hours in order to fuse and cure the coating. The coating is then diamond turned to give it non-print characteristics and is then further heated for 2 hours at 240° C. It is then laser engraved, and optionally etched. It can then be used for gravure printing.

EXAMPLE 3

A bisphenol A epichlorhydrin resin is reacted with a dimer acid and 90 parts by weight of the reaction product are blended with 10 parts by weight of a low molecular weight novolac resin formed by reacting formaldehyde with dihydroxy monomethoxy benzene. The blend is heated to cause partial reaction and is then cooled and solidified to terminate reaction and to produce a powder. 100 parts of this powder are blended with 6 parts of carbon black, about 0.5 parts benzoin and a small amount of polyacrylic acid flowing agent sold under the trade name Modaflow.

A metal cylinder is heated to 220° C. and the powdered epoxy composition is sprayed onto it using an electrostatic powder spray gun. Optionally the metal cylinder may first be coated with a primer, as in example 2. The powdered composition is applied to give a coating thickness of about 0.8 mm and cures on the substrate, while the substrate is cooling towards ambient temperature.

The coated substrate is then diamond turned and laser engraved to form an intaglio print surface. It is then heated to 240° C. for 3 hours.

The resultant print member can be used for a print run in excess of 1 million copies.

EXAMPLE 4

The process of Example 3 is repeated but using an epoxy:novolac weight ratio of 7:3 and including additionally a trace amount of 2-methyl imidazole as accelerator.

We claim:

1. A print member of improved wear resistance having a polished print surface consisting essestially of an epoxy novolac resin.

2. A print member according to claim 1 in which the epoxy novolac is selected from resins obtained by curing a novolac resin substituted by at least 2 epoxy groups per molecule and resins obtained by reacting an epoxy resin with at least 0.5 moles novolac resin per mole epoxy resin.

3. A print member according to claim 1 in which the epoxy novolac is a resin obtained by reacting 1 mole of an epichlorhydrin-bisphenol A epoxy resin with at least 1.1 moles of a novolac resin.

4. A method of forming a print member of improved wear resistance having a print surface consisting essentially of an epoxy novolac resin by powder coating a powdered epoxy novolac resin composition onto a substrate and then fusing and curing the coating and polishing the print surface to give non-print characteristics.

5. A method according to claim 4 in which the epoxy novolac composition is selected from compositions comprising a blend of curing agent with a novolac resin substituted by at least 2 epoxy groups and compositions obtained by blending an epoxy resin with at least 0.5 moles novolac resin per mole epoxy resin.

6. A method according to claim 4 in which the epoxy novolac composition is a composition obtained by blending 1 mole epichlorhydrin bisphenol A epoxy resin with at least 1.1 moles of a novolac resin.

7. A method according to claim 4 in which after the polishing of the print surface it is heated to effect further curing of the surface layer of the epoxy novolac resin.

8. A method according to claim 4 in which after the polishing of the print surface it is heated at a temperature of 200° to 260° C. for half to six hours in order to effect further curing of the surface layer of the epoxy novolac resin.

9. A method according to claim 4 in which after the polishing of the print surface it is heated to effect further curing of the surface layer of the epoxy resin and the novolac resin is formed from a phenol substituted by at least 1 additional hydroxy group and/or by an alkoxy group.

10. A method according to claim 4 in which after the polishing of the print surface it is heated to effect further curing of the surface layer of the epoxy novolac resin and the novolac resin is formed from a methoxy substituted mono or dihydric phenol.

11. A method according to claim 4 in which the epoxy resin is formed from 1 mole of a bisphenol A epichlorhydrin resin and from 1.25 to 3 moles of a novolac resin.

12. A method according to claim 4 in which after the polishing of the print surface it is heated to effect further curing of the surface layer of the epoxy novolac resin and in which the further heating is effected after engraving the surface.

13. A method according to claim 4 in which the substrate is preheated to the curing temperature of the epoxy novolac resin and the powdered resin is powder coated onto the heated substrate, flows into a uniform layer of the desired thickness and cures without substantial further heating.

14. A method of forming a print member of improved wear resistance having a print surface consisting essentially of an epoxy novolac resin by powder coating a powdered epoxy novolac resin composition onto a substrate and then fusing and curing the coating and polishing the print surface to give non-print characteristics wherein the print surface is laser engraved after the polishing.

15. A method according to claim 14 in which the epoxy novolac composition is selected from compositions comprising a blend of curing agent with a novolac resin substituted by at least 2 epoxy groups and compositions obtained by blending an epoxy resin with at least 0.5 moles novolac resin per mole epoxy resin.

16. A method according to claim 14 in which the epoxy novolac composition is a composition obtained by blending 1 mole epichlorhydrin bisphenol A epoxy resin with at least 1.1 moles of novolac resin.

17. A method according to claim 14 in which after the polishing of the print surface it is heated to effect further curing of the surface layer of the epoxy novolac resin.

18. A method according to claim 14 in which after the polishing of the print surface it is heated at a temperature of 200° to 260° C. for half to six hours in order to effect further curing of the surface layer of the epoxy novolac resin.

19. A method according to claim 14 in which after the polishing of the print surface it is heated to effect further curing of the surface layer of the epoxy resin and the novolac resin is formed from a phenol substituted by at least 1 additional hydroxy group and/or by an alkoxy group.

20. A method according to claim 14 in which after the polishing of the print surface it is heated to effect further curing of the surface layer of the epoxy novolac resin and the novolac resin is formed from a methoxy substituted mono or dihydric phenol.

21. A method according to claim 14 in which the epoxy resin is formed from 1 mole of bisphenol A epichlorhydrin resin and from 1.25 to 3 moles of a novolac resin.

22. A method according to claim 14 in which after the polishing of the print surface it is heated to effect further curing of the surface layer of the epoxy novolac resin and in which the further heating is effected after engraving the surface.

23. A method according to claim 14 in which the substrate is preheated to the curing temperature of the epoxy novolac resin and the powdered resin is powder coated onto the heated substrate, flows into a uniform layer of the desired thickness and cures without substantial further heating.

24. A print member according to claim 1 wherein the epoxy novolac resin is at least 80% by weight of the print member.

25. A print member according to claim 1 wherein the epoxy novolac resin is at least 90% by weight of the print member.

26. A print member according to claim 1 wherein the print surface comprises engraved walls separated by areas with non-printing characteristics.

27. A print member according to claim 1 wherein the print surface is a gravure print surface engraved to a depth of up to 30 microns where the epoxy novolac resin layer is 0.2–1.5 mm thick.

28. A print member according to claim 1 which is on a metal cylinder.

29. A method according to claim 4 wherein the print member is at least 80% by weight epoxy novolac resin.

30. A method according to claim 4 wherein the print member is at least 90% by weight epoxy novolac resin.

31. A method according to claim 4 wherein the print surface comprises engraved walls separated by areas with non-print characteristics.

32. A method according to claim 4 wherein the print surface is a gravure print surface engraved to a depth of up to 30 microns where the epoxy novolac resin composition is 0.2–1.5 mm thick.

33. A method according to claim 4 wherein the print member is on a metallic cylinder.

34. A method according to claim 14 wherein the print member is at least 80% by weight epoxy novolac resin.

35. A method according to claim 14 wherein the print member is at least 90% by weight epoxy novolac resin.

36. A method according to claim 14 wherein the print surface comprises engraved walls separated by areas with non-print characteristics.

37. A method according to claim 14 wherein the print surface is a gravure print surface engraved to a depth of up to 30 microns where the epoxy novolac resin composition is 0.2–1.5 mm thick.

38. A method according to claim 4 wherein the print member is on a metallic cylinder.

* * * * *